US010894307B2

(12) United States Patent
Zhou et al.

(10) Patent No.: US 10,894,307 B2
(45) Date of Patent: Jan. 19, 2021

(54) METHOD FOR OPERATING A POWER TOOL

(71) Applicant: Robert Bosch GmbH, Stuttgart (DE)

(72) Inventors: Fanghui Zhou, DingQiao Town (CN); Inn Kean Chong, Pulau Pinang (MY)

(73) Assignee: Robert Bosch GmbH, Stuttgart (DE)

( * ) Notice: Subject to any disclaimer, the term of this patent is extended or adjusted under 35 U.S.C. 154(b) by 312 days.

(21) Appl. No.: 16/063,895

(22) PCT Filed: Nov. 30, 2016

(86) PCT No.: PCT/EP2016/079198

§ 371 (c)(1),
(2) Date: Jun. 19, 2018

(87) PCT Pub. No.: WO2017/108352

PCT Pub. Date: Jun. 29, 2017

(65) Prior Publication Data

US 2018/0370000 A1 Dec. 27, 2018

(30) Foreign Application Priority Data

Dec. 21, 2015 (DE) ..... 10 2015 226 374

(51) Int. Cl.
*B25B 23/147* (2006.01)

(52) U.S. Cl.
CPC ..... *B25B 23/147* (2013.01)

(58) Field of Classification Search
CPC ..... B25B 15/00; B25B 17/00; B25B 17/02; B25B 19/00; B25B 21/00; B25B 23/00;
(Continued)

(56) References Cited

U.S. PATENT DOCUMENTS 9,762,153 B2 * 9/2017 Forster ..... H02P 6/28
10,183,384 B2 * 1/2019 Takano ..... B25B 21/02
2003/0149508 A1 8/2003 Watanabe

FOREIGN PATENT DOCUMENTS

CN 105142862 A 12/2015
DE 196 20 782 A1 12/1996
(Continued)

OTHER PUBLICATIONS

International Search Report corresponding to PCT Application No. PCT/EP2016/079198, dated Mar. 27, 2017 (German and document) (5 pages).

*Primary Examiner* — Antony M Paul
(74) *Attorney, Agent, or Firm* — Maginot, Moore & Beck LLP

(57) ABSTRACT

A method for operating a power tool having a motor for removing a screw from a counterpart is disclosed. A rotary element connects to the power tool to the screw. In a first section, if a first power limit is exceeded for a first duration, a change is made to a second section in which a temporal profile of the power is recorded for a second duration. A change is made into a third region when the power is above a second power limit for the second duration and a temporal fluctuation of the power is within a fluctuation value. A third power limit is determined based on power recorded in the second section. A change is made from the third section into a fourth section when the power drops below the third power limit within a third duration. In the fourth section, the power of the motor is reduced.

19 Claims, 2 Drawing Sheets

(58) Field of Classification Search
CPC ... B25B 23/101; B25B 23/1425; B25B 27/00; B25B 31/00; B25B 23/147; B25F 5/02; B25G 1/00; B23P 19/00; B23P 19/06; B23P 19/065; H02P 1/00; H02P 1/04; H02P 1/16; H02P 1/18; H02P 1/24; H02P 1/26; H02P 1/423; H02P 1/46; H02P 1/465; H02P 3/00; H02P 3/04; H02P 3/08; H02P 3/16; H02P 3/18; H02P 6/00; H02P 6/002; H02P 6/24; H02P 7/00; H02P 7/29; H02P 8/00; H02P 8/24; H02P 21/00; H02P 21/0035; H02P 27/00; H02P 27/04; H02P 27/06; H02P 23/00; H02P 25/00
USPC ..... 318/400.22, 741, 362, 759, 798, 800, 318/801, 812, 277, 371, 372, 375, 430
See application file for complete search history.

(56) References Cited

FOREIGN PATENT DOCUMENTS

| | | |
|---|---|---|
| DE | 10 2009 002 858 A1 | 11/2010 |
| EP | 2 671 681 A2 | 12/2013 |

* cited by examiner

METHOD FOR OPERATING A POWER TOOL

This application is a 35 U.S.C. § 371 National Stage Application of PCT/EP2016/079198, filed on Nov. 30, 2016, which claims the benefit of priority to Serial No. DE 10 2015 226 374.6, filed on Dec. 21, 2015 in Germany, the disclosures of which are incorporated herein by reference in their entirety.

The disclosure relates to a method for operating an electric power tool, to a control device for executing the method, and to an electric power tool.

BACKGROUND

There are known in the prior art, for example, battery-operated electric screwdrivers that are used for tightening or releasing a screw. In the case of releasing a screw, it may be advantageous to automatically terminate the rotation of the electric power tool, as described in US 2003 014 9508 A1.

SUMMARY

The object of the disclosure consists in providing an improved method for releasing a screw element by means of an electric power tool.

The object of the disclosure is achieved by embodiments of the disclosure.

An advantage of the method described consists in that a to the screw element and the form-fitting and/or force-fitting connection of the screw element to a counterpart is taken into account in the release operation. The power can thus be better adapted to the situation that exists. These advantages are achieved by the proposed method for operating an electric power tool having an electric motor for releasing a screw element from a counterpart, wherein, in a second segment, a progression of the power over time is measured for a predefined second time period, wherein a changeover to a third region is effected if the power during the second time period is above a second power limit and a fluctuation of the power over time is within a predefined fluctuation value, wherein a third power limit is determined in dependence on the measured power in the second segment, wherein a changeover from the third segment to a fourth segment is effected if the power drops below the third power limit within a predefined third time period, wherein, in the fourth segment, the power of the electric motor is reduced by at least 30%. Owing to the third power limit being determined in dependence on the power in the second segment, improved releasing of the screw element is achieved, with the load on the screw element being reduced and energy saved in releasing the screw element. This is advantageous, in particular, in the case of electric power tools that are supplied with electric power from a battery.

In one embodiment, in the second segment at least two, in particular five, measurements of the power consumed by the electric motor are performed, wherein a changeover to the third segment is effected if the measured power values lie within the predefined fluctuation value. This enables the connection power that is present between the screw element and the counterpart to be measured with greater precision.

In one embodiment, the measurements of the power are in each case performed for a predefined time period, in particular for at least 8 milliseconds, wherein the measured power values are averaged, wherein a changeover to the third segment is effected if the averaged power values lie within the predefined fluctuation value. This enables the connection force that is actually present to be measured with greater precision.

In one embodiment, the power is measured on the basis of an amperage that is consumed by the electric motor. This enables the power to be estimated by the use of simple means.

In one embodiment, the third power limit is determined from an averaged sum of the power values measured in the second segment, multiplied by a factor of less than 1. A suitable determination of the third power limit can thereby be achieved in a simple manner.

In one embodiment, a predefined value is assigned to the third power limit if the conditions of the second segment are not fulfilled within a predefined time period, and then branching to the third segment is effected. Functioning of the method is thereby ensured.

In one embodiment, in the fourth segment, a rotation of the rotation element is braked, in particular stopped, following attainment of a predefined number of revolutions. Complete releasing of the screw element from the counterpart is thereby avoided.

In one embodiment, the power of the electric motor is reduced, in particular the electric motor is switched off, if it is ascertained in the second segment that the power consumed by the electric motor is below the second power limit. A load-free situation, in which no releasing of a screw element is required, can thus be identified, and energy saved.

In one embodiment, the first power limit is greater than the second power limit. Tests have shown that good release operations are achieved as a result.

The proposed electric power tool has an electric motor for rotating a rotation element, an electric power supply, a switch for selecting an automatic release function for releasing a screw element from a counterpart.

In one embodiment, a display is provided, wherein the display indicates whether the automatic release function has been activated. An operating function can thereby monitor the functioning of the electric power tool, and is not surprised by the automatic function.

In one embodiment, the display is arranged in a lower region of a handle of the electric power tool. The display is thus easily visible to the operator.

In one embodiment, the display is designed to indicate at least two rotational speeds of the rotation element.

In one embodiment, the switch and the display are arranged next to each other.

BRIEF DESCRIPTION OF THE DRAWINGS

The disclosure is explained in greater detail in the following on the basis of the figures. There are shown.

DETAILED DESCRIPTION

Figure 1:
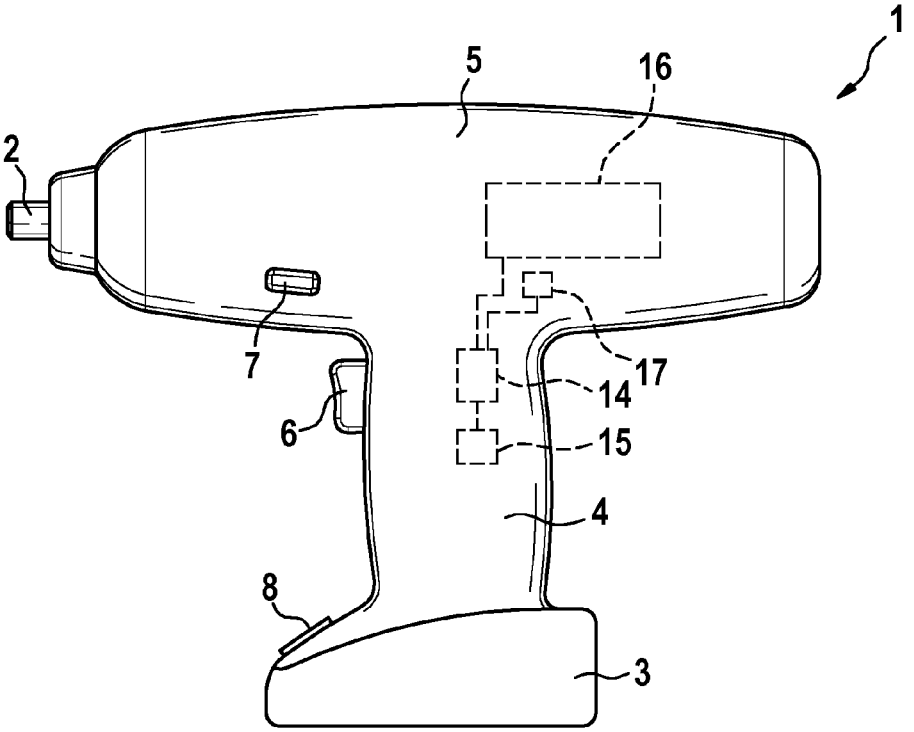
FIG. 1 an electric power tool 1, in a schematic representation.

FIG. 1, in a schematic representation, shows an electric power tool 1, which has a rotation element 2 that is operatively connected to a screw element for the purpose of rotating the screw element, in particular for the purpose of releasing the screw element from a counterpart. The electric power tool has an electric motor 16, which is connected to an electric power source. The electric power source may be provided by an accumulator battery, i.e. a rechargeable battery, or by a mains electric power supply. In the exemplary embodiment represented, an accumulator battery 3 is provided, which is releasably arranged, for example, at a lower end of a handle 4 of the electric power tool 1. At the upper end, the handle 4 transitions into a motor housing 5, at the front end of which the rotation element 2 is realized. The rotation element 2 is put into clockwise or anti-clockwise rotation by the electric motor, depending on the rotation direction that is selected. For the purpose of actuating the electric power tool, a pushbutton switch is provided at the upper end of the handle 4. Upon depression of the pushbutton switch 6 toward the handle 4, the rotation element 2 is put into rotation. Furthermore, there is a rotation direction selector 7 provided on a side face, at the upper end region of the handle 4. The rotation direction selector 7 selects the rotation direction. The operator can thus use the rotation direction selector 7 to specify whether a screw element is to be driven onto, or unscrewed, i.e. released, from the counterpart. The electric power tool has a control device 14, which are provided with sensors 17 for sensing the power that is delivered by the electric motor. For example, the power of the electric power tool can be estimated on the basis of the amperage consumed by the electric motor. In addition, the control device 14 is connected to a data storage means 15. Furthermore, the control device 14 is designed to influence the functioning of the electric motor 16, in particular to control the power and/or to brake the rotation of the rotation element 2. The electric motor 16 is supplied, for example, with a pulse-width modulated voltage, which is controlled by the control device.

In the exemplary embodiment represented, provided at the lower end of the handle 4 there is a display 4, which indicates to an operator whether an operation for automatically releasing the screw element is active. For this purpose, the display 8 has corresponding optical means for indication. For example, the display 8 is illuminated, in particular in red, if the operation for automatically releasing the screw element is active.

Figure 2:
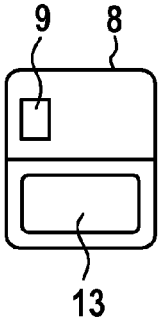
FIG. 2 an enlarged representation of a display.

FIG. 2 shows the display 8 in an enlarged representation, the display 8 having a display panel 9 that is illuminated or flashes when an automatic release function is active. In addition, provided next to the indication panel 9 is an actuation panel 13, in which a pushbutton switch is provided. Pressing on the actuation panel 13 actuates the pushbutton switch, and the selection of the automatic release operation is activated.

Figure 3:
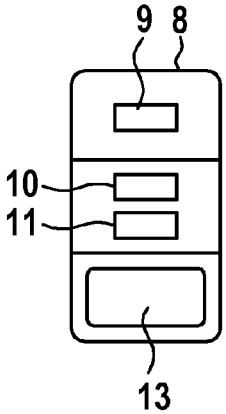
FIG. 3 an enlarged representation of a further embodiment of the display.

FIG. 3 shows a further embodiment of the display 8 in which, in addition to the display panel 9, a rotational-speed display is provided, in the form of two further panels 10, 11. The first further display panel 10 is illuminated if the rotational speed of the electric power tool is within a first rotational speed range. The second further display panel 11 is illuminated if the rotational speed of the electric power tool is within a second rotational speed range, the second rotational speed range being greater than the first rotational speed range.

Figure 4:
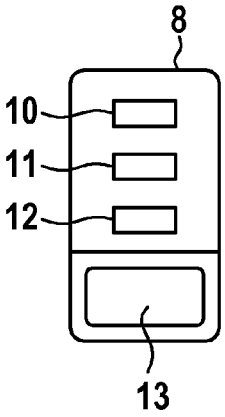
FIG. 4 an enlarged representation of a further display.

FIG. 4 shows a further embodiment, in which three further display panels 10, 11, 12, for indicating three rotational speed ranges, are provided. In this embodiment, the display panel 9 has been omitted.

Depending on the embodiment selected, the actuation panel 13 may be omitted, and the automatic release function started automatically by a control device of the electric power tool if predefined boundary conditions are present.

Figure 5:
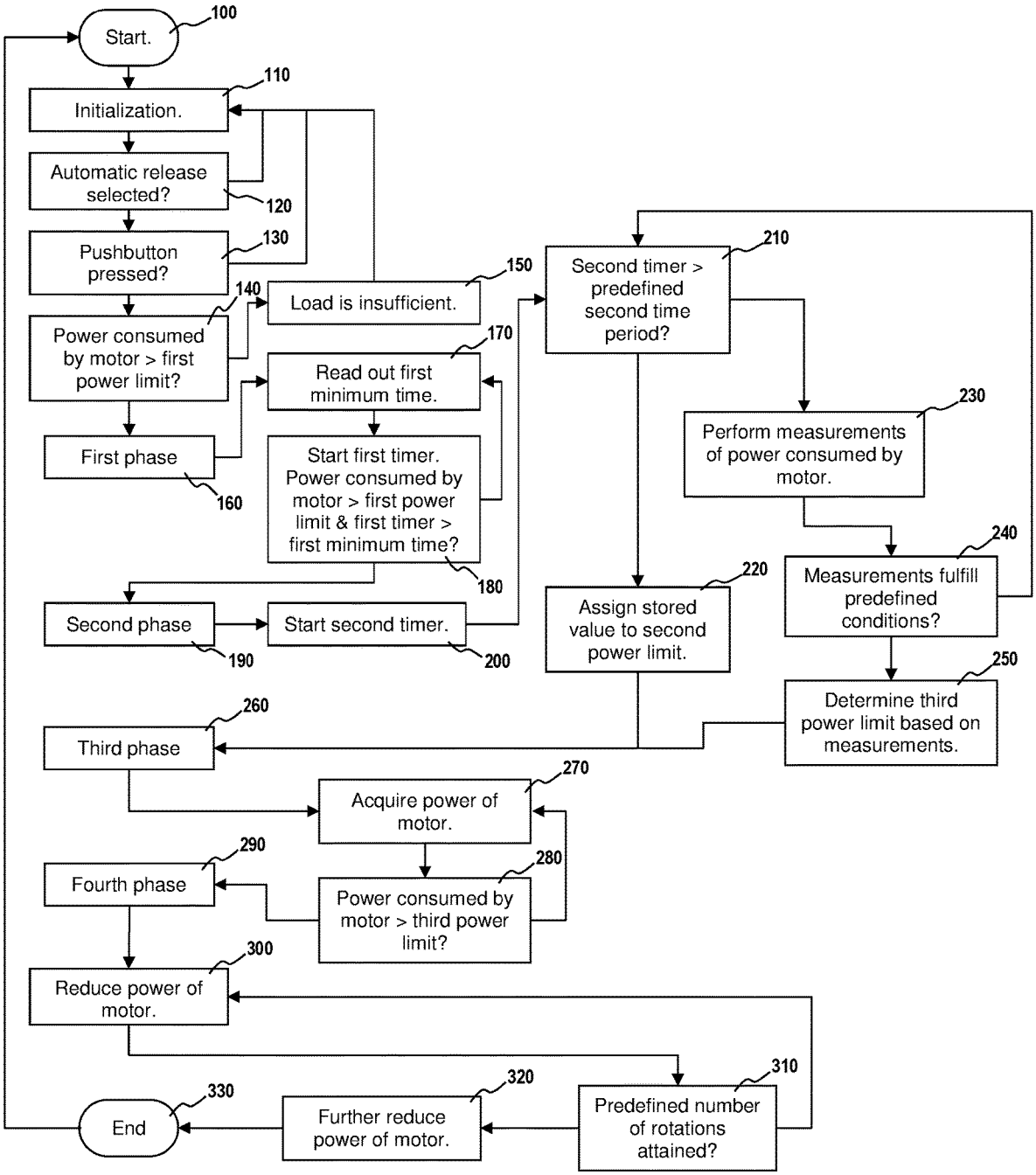
FIG. 5 a schematic representation of a program sequence for executing the method.

FIG. 5, in a schematic representation, shows a program sequence for operating the electric power tool. The program is started at the program point 100. At program point 110 initialization of the control device is performed, or the electric power tool is operated in a normal mode in which, for example, the rotational speed of the rotation element 2 is set in dependence on the depth of depression of the pushbutton switch 6. At program point 120 it is checked whether the program for automatic release of a screw element has been selected and the electric power tool 1 is in the rotation direction for releasing a screw element. For example, it is checked whether the actuation panel 13 has been pressed. Depending on the embodiment selected, determination of whether an automatic release operation is to be performed may also be determined by the control device, on the basis of predefined parameters that are stored in a data storage device. For example, the automatic release operation may always be activated in the case of a rotation direction of the rotation element that corresponds to releasing of a screw element, i.e. in the case of anti-clockwise rotation. If this is not the case, the program branches back to program point 110.

If, however, it is identified at program point 120 that the automatic release function is to be performed, the program branches to program point 130.

At program point 130 it is checked whether the pushbutton switch 6 has been pressed. If this is not the case, the programs branches back to program point 110. If the pushbutton switch 6 is not pressed, then rotation of the rotation element is not required. If the pushbutton switch 6 has been pressed at program point 130, however, the program branches to program point 140.

At program point 140 it is checked whether the power consumed by the electric motor is above a first power limit. The consumed power is, for example, sensed by means of a sensor 16 or estimated by the control device on the basis of operating parameters such as, for example, a depression depth of the pushbutton switch 6. The first power limit may be, for example, 20 A. The first power limit may depend on the type of electric power tool and on further boundary conditions that, for example, are acquired by the control device 14 or stored in the data storage device. The first power limit may be stored in the data storage device 15. If it is identified at program point 140 that the first power limit is not exceeded, the program branches to program point 150. At program point 150 it is identified that there is an insufficient load present, and the rotation of the electric motor is reduced by the control device 14, in particular the power supply to the electric motor is reduced, and for example reduced t0 the value 0. The program then branches back to the program point 110.

If it is identified at program point 140 that the electric motor is consuming more power than the first power limit, then, at program point 160, the presence of a first phase is recognized. The program then branches to program point 170. At program point 170 a first minimum time is read out from the data storage device 15. The first minimum time may be predefined so as to be constant, or stored, in the form of a table and characteristic, in the data storage device 15, in dependence on the first power limit or in dependence on further operating parameters. The first minimum time may be, for example, 80 ms.

At program point 180 a first time counter is started, and it is checked whether the electric motor consumes a quantity of power, that is above the first power limit, for longer than the predefined first minimum time. If it is established by the check at program point 180 that the electric motor has consumed a quantity of power, that is always above the first power limit, for longer than the first minimum time, then, at program point 190, the presence of a second phase is recognized. After program point 190, the program branches to program point 200.

At program point 200 a second time counter is started. At program point 210 it is checked whether the second time counter has reached a predefined second time period. The second time period may be predefined so as to be constant, or stored, in the form of a table and characteristic, in the data storage device 15, in dependence on the first power limit or in dependence on further operating parameters. The second time period may be, for example, 80 ms.

If, at program point 210, the program identifies that the second time counter has reached the second time period, the program branches to program point 220, and a value that is stored in the data storage device 15 is assigned to second power limit. The second power limit defined at program point 220 may have differing values, depending on the electric power tool used and on the operating conditions present. For example, the second power limit may be less than the first power limit. The program point 220 is provided to provide a first power limit in the case of boundary conditions that are not easily measured.

If the query at program point 210 establishes that the second time period has not yet been reached, the program branches to program point 230. At program point 230 a plurality of measurements of the power consumed by the electric motor are performed. For example, in this case five measurements of the power are performed in succession. The measurements are performed in a predefined time window, for example within 40 ms. In a following program point 240 it is checked whether the performed measurements fulfill predefined conditions. The predefined conditions are stored in the data storage device. The condition consists, for example, in that the measured power values must each be over a predefined second power limit. The second power limit may be, for example, 19 A.

A further condition consists, for example, in that the fluctuations of the measured power values, i.e. the differences of the measured power values, are less than a predefined value. For example, the predefined value for the fluctuation may be 10% of an averaged power. The averaged power may be determined by the sum of the averaged measured power values, averaged by the number of measurements. This means that, in order to fulfill this condition, the averaged measured power values are allowed to deviate by less than 10% from an averaged value of the measured power values. The value for the fluctuation may also be predefined as a constant value, and have an amperage of, for example, 4 A.

If, at program point 240, the predefined conditions are not fulfilled, then the program branches back to program point 220. The second time period is designed to be of such a length that, for example, two or more measurement operations and evaluations, according to program points 230 and 240, can be performed before the program branches to program point 220.

If, however, the query at program point 240 establishes that the predefined conditions are fulfilled by the measured power values, the program branches to program point 250. At program point 250 a third power limit is determined on the basis of the measurements of the power values performed at program point 230. For example, the third power limit is calculated from the averaged value of the measured power values multiplied by a factor of less than 1, for example 0.7. Depending on the embodiment selected, other processes and calculation methods may also be used to determine the third power limit on the basis of the measured power values. The program then branches to program point 260.

Following execution of program point 220, also, the program branches to program point 260. At program point 260 a third phase is recognized. The program then branches to program point 270. At program point 270 the power of the electric motor is acquired. In a subsequent program point 280 it is checked whether the power consumed by the electric motor is less than the third power limit for a predefined third time period. The third time period may be, for example, 16 ms, and stored in the data storage device 15. If the condition of program point 280 is not fulfilled, the program branches back to program point 270. If, however, the condition of program point 280 is fulfilled, the program branches to program point 290 and a fourth phase is recognized. After program point 290, the program branches to program point 300. At program point 300 the power of the electric motor is reduced by the control device. In this case, the power is reduced by at least 30%. The electric motor may be controlled, for example, by mans of a pulse-width modulated signal. The reduction in power at program point 300 may also be up to 70%. In addition, the number of revolutions of the rotation element 2 is counted by means of a further sensor 17, for example by mans of a Hall sensor.

Then, at program point 310, it is checked whether a predefined number of rotations has been attained. If this is not the case, the program branches back to program point 300. If, however, it is established at program point 310 that a predefined number of revolutions has been executed in the fourth phase, the program branches to program point 320. At program point 320 the power of the electric motor is reduced further, in particular the electric motor is switched off. In addition, the rotation element may also be braked. For this purpose, mechanical means, or a corresponding pulse-width modulated control of the electric motor may be effected. Then, at program point 330, the end of the automatic release operation is established, and the program branches back to program point 110.

The predefined number of revolutions, after which a changeover is effected from program point 310 to program point 320, may be, for example, four. Depending on the embodiment selected, however, other numbers, i.e. lesser or greater numbers, of rotations may be provided before a changeover to program point 320 is effected.

Depending on the embodiment selected, the power may also be estimated or measured by means other than by measurement of the consumed amperage.

The first region serves to identify the presence of a load with the presence of the automatic release function.

In the second region, the presence of a fastening situation is sensed, and in dependence thereon, a limit value for the first power limit is determined. Depending on the embodiment selected, the averaged value may also be multiplied by a factor of 0.5 or 0.8 at program point 250.

The third region is provided to identify the presence of a released screw element.

The fourth region is provided in order, following the identification of a released screw, to perform further release of the screw, preferably without the screw being fully released from the counterpart, in particular from a thread bolt.

By means of the proposed method, improved release of a screw element is achieved, and in particular complete release of the screw element from a counterpart, in particular a bolt, is to be avoided. The screw element may be realized as a screw, as a bolt, or also in another form.

The invention claimed is:

1. A method for operating an electric power tool having an electric motor configured to release a screw element from a counterpart, the electric power tool being operatively connected to the screw element by a rotation element, the method comprising:

checking, in a first phase, whether a power of the electric motor exceeds a predefined first power limit for a predefined first minimum time;

effecting a changeover to a second phase after the first power limit has been exceeded for the first minimum time;

measuring, in the second phase, a progression of the power over time for a predefined second time period;

effecting a changeover to a third phase in response to the power during the second time period being above a second power limit and a fluctuation of the power over time being within a predefined fluctuation value;

determining a third power limit in dependence on the power in the second phase;

effecting a changeover from the third phase to a fourth phase in response to the power dropping below the third power limit within a predefined third time period; and reducing, in the fourth phase, the power of the electric motor by at least 30%.

2. The method as claimed in claim 1 further comprising:

performing, in the second phase, at least two measurements of the power consumed by the electric motor; and effecting a changeover to the third phase in response to the at least two measurements of the power lying within the predefined fluctuation value.

3. The method as claimed in claim 2 further comprising:

performing the at least two measurements of the power in each case for a predefined time period;

averaging the at least two measurements of the power; and effecting a changeover to the third phase in response to the averaged power values lying within the predefined fluctuation value.

4. The method as claimed in claim 3, wherein the predefined time period is at least eight milliseconds.

5. The method as claimed in claim 2 further comprising:

measuring the power on the basis of an amperage that is consumed by the electric motor.

6. The method as claimed in claim 2, wherein the at least two measurements of the power consumed by the electric motor include five measurements of the power consumed by the electric motor.

7. The method as claimed in claim 1 further comprising:

determining the third power limit from an averaged sum of the progression of the power over time measured in the second phase, multiplied by a factor of less than 1.

8. The method as claimed in claim 1 further comprising:

assigning a predefined value to the third power limit and branching to the third phase in response to conditions of the second phase not being fulfilled within a predefined time period.

9. The method as claimed in claim 1 further comprising:

further reducing, in the fourth phase, after a predefined number of revolutions of the rotation element, the power by at least 50%.

10. The method as claimed in claim 1 further comprising:

braking, in the fourth phase, a rotation of the rotation element following attainment of a predefined number of revolutions.

11. The method as claimed in claim 10 further comprising:

stopping, in the fourth phase, a rotation of the rotation element following attainment of a predefined number of revolutions.

12. The method as claimed in claim 1 further comprising:

reducing the power of the electric motor in response to ascertaining in the second phase that the power consumed by the electric motor is below the second power limit.

13. The method as claimed in claim 12 further comprising:

switching off the power of the electric motor in response to ascertaining in the second phase that the power consumed by the electric motor is below the second power limit.

14. The method as claimed in claim 1, wherein the first power limit is greater than the second power limit.

15. A control device for operating an electric power tool having an electric motor configured to release a screw element from a counterpart, the electric power tool being operatively connected to the screw element by a rotation element, the control device being configured to:

check, in a first phase, whether a power of the electric motor exceeds a predefined first power limit for a predefined first minimum time;

effect a changeover to a second phase after the first power limit has been exceeded for the first minimum time;

measure, in the second phase, a progression of the power over time for a predefined second time period;

effect a changeover to a third phase in response to the power during the second time period being above a second power limit and a fluctuation of the power over time being within a predefined fluctuation value;

determine a third power limit in dependence on the measured progression of the power over time in the second phase;

effect a changeover from the third phase to a fourth phase in response to the power dropping below the third power limit within a predefined third time period; and reduce, in the fourth phase, the power of the electric motor by at least 30%.

16. An electric power tool comprising:

an electric motor configured to rotate a rotation element;

an electric power supply;

a switch configured to select an automatic release function to release a screw element from a counterpart; and a control device configure to, in response to the switch selecting the automatic release function:

check, in a first phase, whether a power of the electric motor exceeds a predefined first power limit for a predefined first minimum time;

effect a changeover to a second phase after the first power limit has been exceeded for the first minimum time;

measure, in the second phase, a progression of the power over time for a predefined second time period;

effect a changeover to a third phase in response to the power during the second time period being above a second power limit and a fluctuation of the power over time being within a predefined fluctuation value;

determine a third power limit in dependence on the measured progression of the power over time in the second phase;

effect a changeover from the third phase to a fourth phase in response to the power dropping below the third power limit within a predefined third time period; and reduce, in the fourth phase, the power of the electric motor by at least 30%.

17. The electric power tool as claimed in claim 16 further comprising:

a display configured to indicate activation of the automatic release function.

18. The electric power tool as claimed in claim 17, wherein the display is arranged in a lower region of a handle of the electric power tool.

19. The electric power tool as claimed in claim 17, wherein:

the display is configured to indicate at least two rotational speeds of the rotation element; and the switch and the display are arranged next to each other.

* * * * *